US007381876B2

(12) United States Patent
Miyajima

(10) Patent No.: US 7,381,876 B2
(45) Date of Patent: Jun. 3, 2008

(54) SIDE DRUM SUPPORT DEVICE

(75) Inventor: Hideyuki Miyajima, Seto (JP)

(73) Assignee: Hoshino Gakki Co., Ltd. (JP)

( * ) Notice: Subject to any disclaimer, the term of this patent is extended or adjusted under 35 U.S.C. 154(b) by 177 days.

(21) Appl. No.: 11/326,219

(22) Filed: Jan. 5, 2006

(65) Prior Publication Data

US 2007/0068365 A1 Mar. 29, 2007

(30) Foreign Application Priority Data

Sep. 16, 2005 (JP) ..... 2005-270212

(51) Int. Cl.
*G10D 13/02* (2006.01)

(52) U.S. Cl. ..... 84/421

(58) Field of Classification Search ..... 84/421
See application file for complete search history.

(56) References Cited

U.S. PATENT DOCUMENTS 2,844,064 A * 7/1958 Bendett ..... 84/421
3,535,976 A * 10/1970 Osuga ..... 84/421
3,539,234 A * 11/1970 Rapata ..... 384/203
3,576,149 A * 4/1971 Slingerland, Jr. ..... 84/421
3,687,509 A * 8/1972 Schweizer ..... 384/210
3,704,645 A * 12/1972 Grauso et al. ..... 84/421
3,874,752 A * 4/1975 Imazaike ..... 384/296
3,945,291 A * 3/1976 Zickos ..... 84/421
3,955,465 A * 5/1976 Zickos ..... 84/411 R
4,126,075 A * 11/1978 Kurosaki ..... 84/421
4,141,272 A * 2/1979 Yanagisawa ..... 84/421
4,337,684 A * 7/1982 Le Mert ..... 84/421
4,747,569 A * 5/1988 Hoshino ..... 248/291.1
4,987,817 A * 1/1991 Diaz ..... 84/421
5,000,608 A * 3/1991 Schmidt ..... 403/92
5,520,292 A * 5/1996 Lombardi ..... 211/85.6
5,735,174 A * 4/1998 Enomoto ..... 74/89.32
5,803,642 A * 9/1998 Sassmannshausen ..... 403/90
5,895,874 A * 4/1999 Liao ..... 84/421
5,949,009 A * 9/1999 Chen ..... 84/421
5,973,248 A * 10/1999 Chen ..... 84/421
6,075,190 A * 6/2000 Mosser et al. ..... 84/421
6,093,878 A * 7/2000 Hoshino ..... 84/421
6,105,594 A * 8/2000 Diaz ..... 135/16
6,172,290 B1 * 1/2001 May ..... 84/421
6,346,665 B1 * 2/2002 Liao ..... 84/421
6,653,540 B2 * 11/2003 Izen et al. ..... 84/421
6,683,239 B1 * 1/2004 Chang ..... 84/421
6,977,332 B2 * 12/2005 Liao ..... 84/421
6,988,696 B2 * 1/2006 Attee ..... 248/214
7,087,825 B2 * 8/2006 Izen et al. ..... 84/411 R
7,087,827 B2 * 8/2006 Liao ..... 84/421
7,128,368 B2 * 10/2006 Sligh ..... 297/186
2007/0068365 A1 * 3/2007 Miyajima ..... 84/421

* cited by examiner

*Primary Examiner*—Lincoln Donovan
*Assistant Examiner*—Robert W Horn
(74) *Attorney, Agent, or Firm*—Ostrolenk, Faber, Gerb & Soffen, LLP

(57) ABSTRACT

A tom holder includes a fastening piece fixed to a bass drum. A support pipe extends upward from the fastening piece. A support bar extends forward from the support pipe. A mount is supported on the support bar in a manner movable relative to the axis of the support bar. The tom holder further includes a longitudinal position adjustment mechanism for horizontally adjusting the position of side drums attached to the mount. The longitudinal position adjustment mechanism changes the position of the holder with respect to the support bar to adjust the horizontal position of the side drums.

18 Claims, 9 Drawing Sheets

SIDE DRUM SUPPORT DEVICE

BACKGROUND OF THE INVENTION

The present invention relates to a support device for supporting a side drum.

A drum set, in general, includes a pair of side drums. Each side drum is supported above a bass drum by a support device or arranged beside a bass drum supported by a stand. A side drum support device includes a mount, which holds the side drum, and a support pipe, which supports the mount. A support device applicable for side drums of various sizes includes a mechanism for adjusting the position of the side drums in the horizontal direction (for example, in the forward and rearward directions) and a mechanism for adjusting the height and angle of the side drums. The structure of such a support device is shown in FIGS. 12 to 15.

For example, U.S. Pat. Nos. 5,973,248 and 5,949,009 describe a structure in which a fastening piece 121 is fixed to the body of a bass drum BD, and a support bar 122 is supported by the fastening piece 121 in a relatively movable manner (see FIG. 12). The support bar 122 has a front end from which a support pipe 123 upwardly extends. A mount 124 holds the side drum SD on the support pipe 123. In this structure, the position of the side drum SD is adjusted in the forward and rearward directions by moving the support bar 122 relative to the fastening piece 121.

Another conventional device shown in FIG. 13 has a support bar 131, which extends horizontally from an angle adjustment mechanism 130. The support bar 131 has a distal end inserted sideward into the body of a side drum SD and fixed to the side drum SD by a clamp 132. A further conventional device shown in FIG. 14 includes a support bar 141 having a distal end fixed to a floating member 143, which is arranged on the side of the side drum SD, by a clamp 142. In these structures, the position of the side drum SD is adjusted in the forward and rearward directions by changing the position at which the support bar 131 or 141 is fixed to the side drum SD or the floating member 143.

In another conventional device shown in FIG. 15, a holder unit 150, which includes an angle adjustment mechanism and a position adjustment mechanism, is attached to the upper end of a support pipe 151. The holder unit 150 includes a unit body 152, a pair of ball members 153, each of which is supported in a rotatable manner in the unit body 152, and support bars 154, each of which is inserted into a hole 153*a* of the corresponding ball member 153. The support bars 154 each support a side drum. In this structure, the angle of each side drum is adjusted by rotating the support bar 154 together with the ball member 153. The position of each side drum in the forward and rearward directions is adjusted by moving the support bar 154 in the hole 153*a* of the ball member 153.

When a plurality of side drums are arranged above a bass drum, the height and angle of each side drum and the positional relationship between the side drums are adjusted so that the drums can be beaten at the best positions. However, in the device shown in FIG. 12, the distance d1 between a load point P of the side drum SD and a fixed point Q of the support bar 122 is long. This increases the load applied to the fixed point Q and produces a bending force between the fastening piece 121 and the support bar 122. As a result, it becomes extremely difficult to horizontally move the side drum SD in a state held by the mount 124. The devices shown in FIGS. 13 and 14 have a disadvantage in that horizontal movement of one of the side drums SD will change the positional relationship with the other side drum SD. In the device shown in FIG. 14, the support bar 141 cannot be inserted into the side drum SD. Thus, the adjustment amount for adjusting the position of the side drum SD in the horizontal direction is insufficient. Further, in the device shown in FIG. 15, the holder unit 150 includes both the angle adjustment mechanism and the position adjustment mechanism. Therefore, adjustment of the angle of the side drum SD would change the position in the forward and rearward directions. Accordingly, although employment of the conventional devices would enable the position of the side drums SD to be adjusted in the horizontal direction, such adjustment is far from easy. Therefore, further improvement is required in this respect.

SUMMARY OF THE INVENTION

It is an object of the present invention to provide a side drum support device enabling the position of a side drum to be easily adjusted in the horizontal direction.

One aspect of the present invention is a support device for a side drum. The support device includes a mount to which the side drum is attached. A support post supports the mount. A position adjustment mechanism adjusts the position of the side drum in a horizontal direction. A support bar is arranged on the support post and extends horizontally. The mount is supported in a manner movable relative to the support bar along the axis of the support bar. The position adjustment mechanism changes the position of the mount relative to the support bar and adjusts the position of the side drum in the horizontal direction.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be described with reference to FIGS. 1 to 7.

Figure 1:
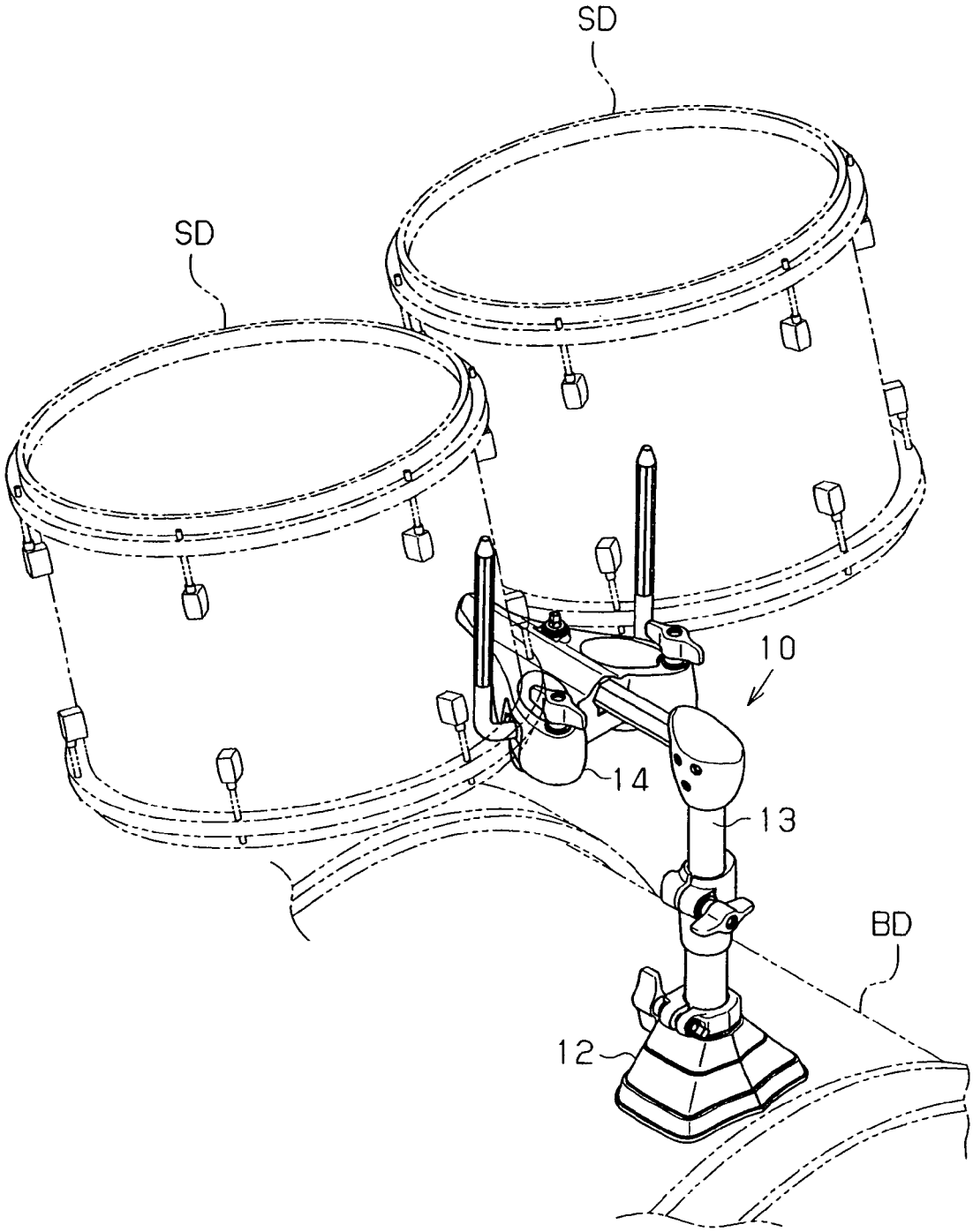
FIG. 1 is a perspective view showing a state in which side drums are supported above a bass drum by a tom holder according to a preferred embodiment of the present invention.

As shown in FIG. 1, a tom holder 10, which functions as a support device, includes a fastening piece 12 fixed to a bass drum BD, a support pipe 13 extending upward from the fastening piece 12 and serving as a support post, and a mount 14 on which two side drums SD are mounted. In the following description of the structure of the tom holder 10, the side of the tom holder 10 towards the support pipe 13 (the right side as viewed in FIG. 4) corresponds to the front side and the opposite side (the left side in FIG. 4) corresponds to the rear side.

Figure 2:
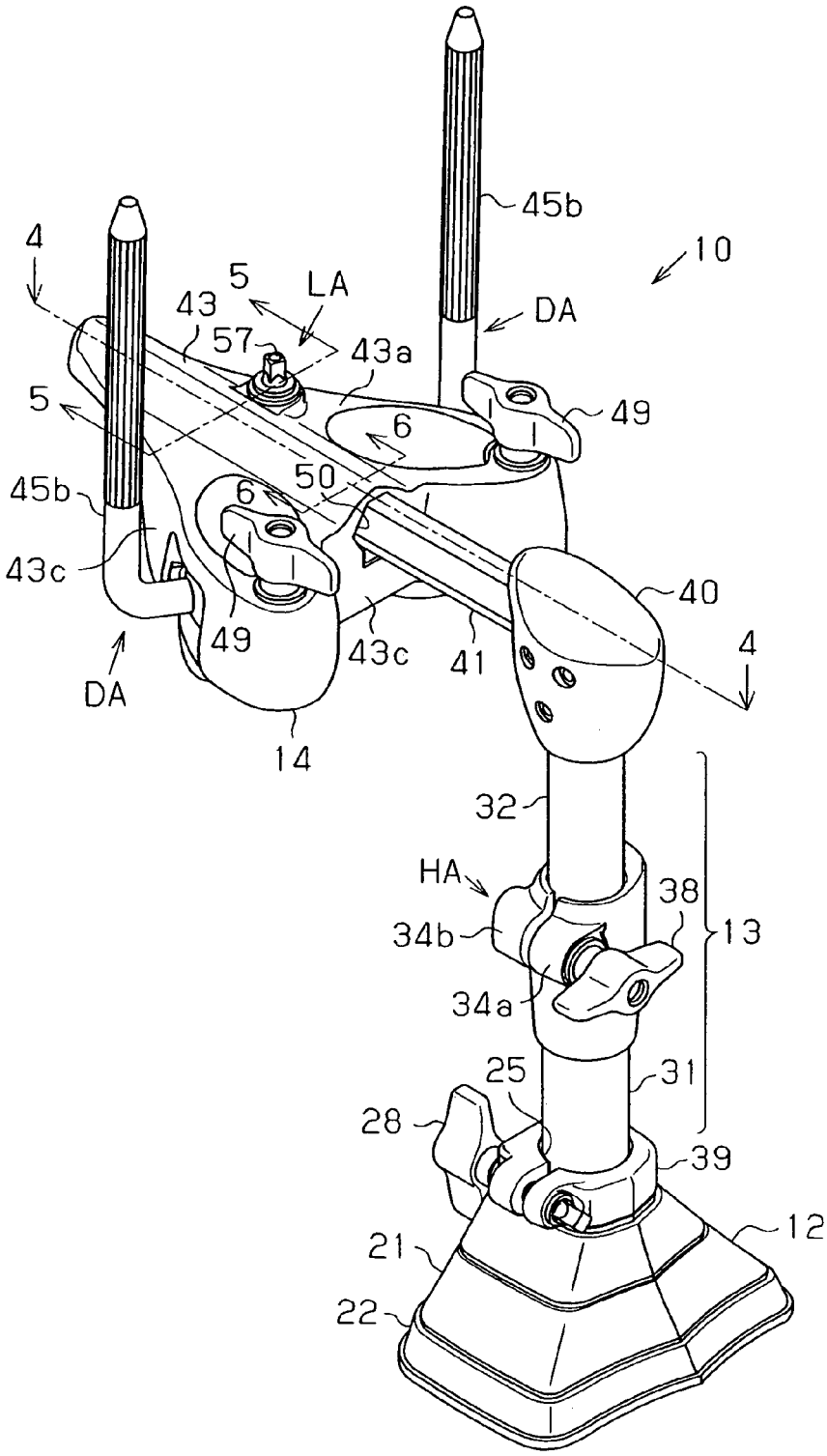
FIG. 2 is a perspective view showing the entire structure of the tom holder.
Figure 3:
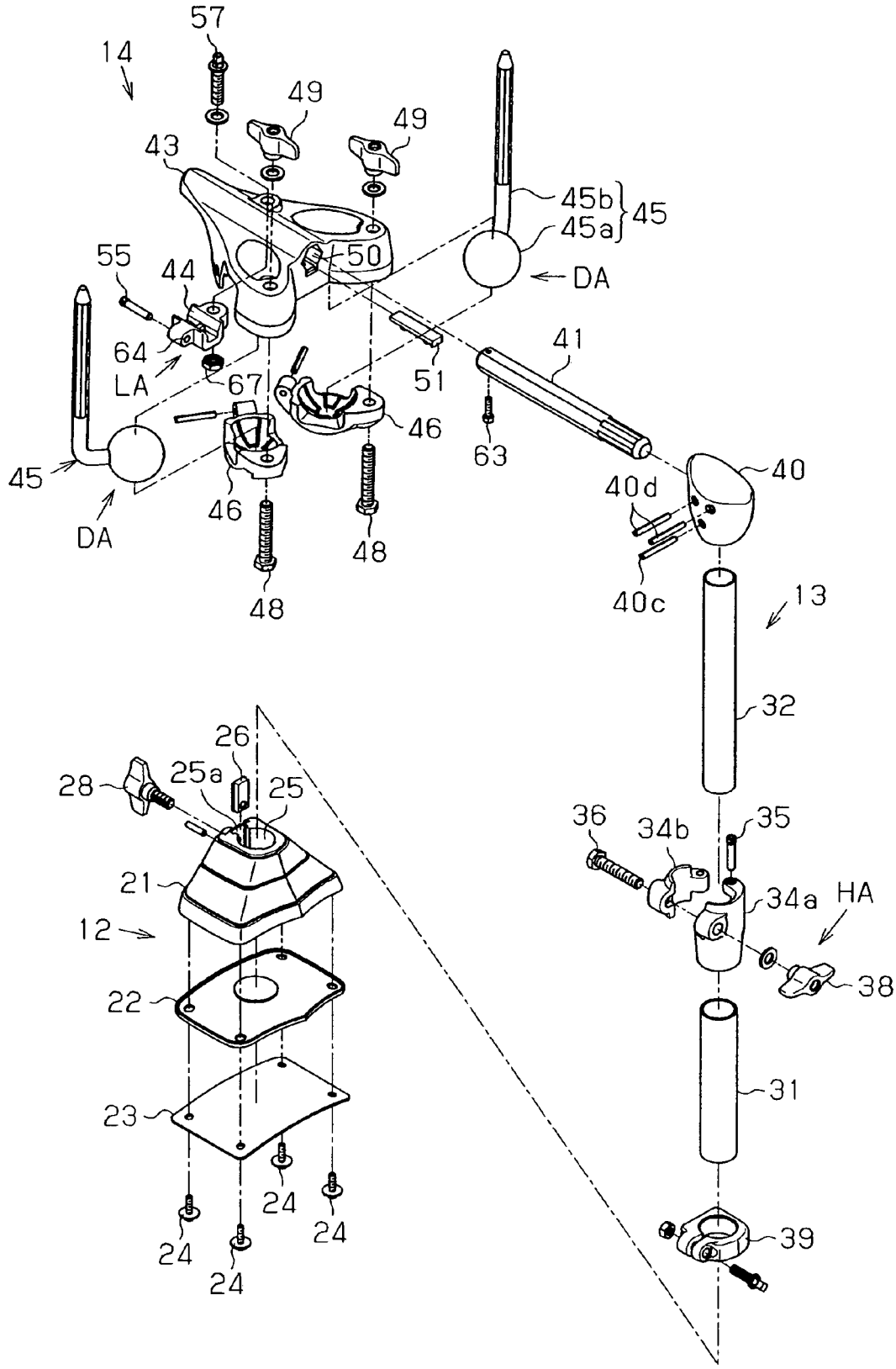
FIG. 3 is an exploded perspective view showing the tom holder.

As shown in FIGS. 1 to 3, the fastening piece 12 includes a base 21, a flat spacer 22 held between the base 21 and the bass drum BD, and a support plate 23 arranged in the bass drum BD. The four corners of the base 21 and spacer 22 are fastened by screws 24 to the bass drum BD with the support plate 23 held in between so as to fix the fastening piece 12 to the wall of the body of the bass drum BD.

A support hole 25 is formed in the upper surface of the base 21 to receive the support pipe 13. A groove 25*a* extends along the wall of the support hole 25 parallel to the axis of the support hole 25. A rectangular pressing plate 26 is arranged in the groove 25*a*. A T-shaped bolt 28 is inserted into the base 21 from the rear and tightened so as to fix the support pipe 13 to the base 21 with the pressing plate 26. The T-shaped bolt 28 is loosened to enable height adjustment of the support pipe 13 or removal of the support pipe 13 from the base 21.

The support pipe 13 includes a lower pipe 31 and an upper pipe 32. The lower end of the upper pipe 32 is inserted into the lower pipe 31, and the upper pipe 32 is movable along the inner surface of the lower pipe 31. A height adjustment mechanism HA is arranged on the upper end of the lower pipe 31 to adjust the height of the side drums SD.

The height adjustment mechanism HA, which includes a fixed pipe clamp 34*a* and a movable pipe clamp 34*b*, is fixed to the lower pipe 31 by the pipe clamp 34*a*. A pin 35 pivotally connects the pipe clamp 34*b* to the pipe clamp 34*a*. A screw 36 is inserted through the pipe clamps 34*a* and 34*b*. The distal end of the screw 36 is then mated with a T-shaped nut 38 with a washer located in between. When the T-shaped nut 38 is tightened, the upper pipe 32 is tightly held between the pipe clamps 34*a* and 34*b* so as to fix the upper pipe 32 to the lower pipe 31. When the T-shaped nut 38 is loosened, the position of the upper pipe 32 with respect to the lower pipe 31 may be adjusted. This adjusts the entire length of the support pipe 13 and thereby adjusts the height of the side drums SD.

A generally annular memory lock 39 is attached to the lower end of the lower pipe 31 by a nut and bolt. The memory lock 39 functions as a positioning member for setting the height and the angle of the support pipe 13, which extends upward from the fastening piece 12.

Figure 4:
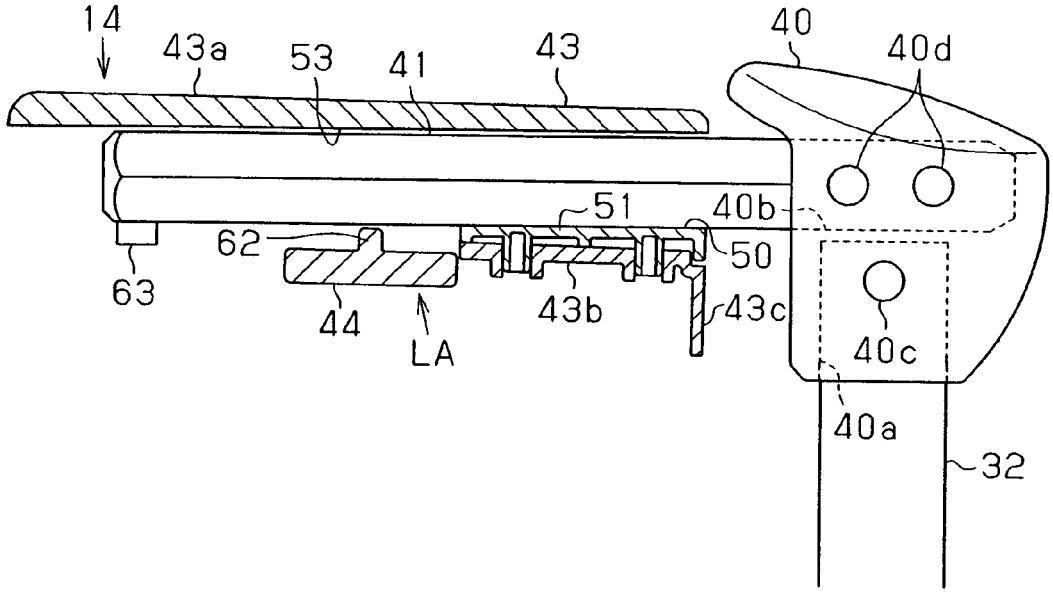
FIG. 4 is a cross-sectional view taken along line 4-4 in FIG. 2.

A mount 14 is connected to the upper end of the upper pipe 32 by a joint 40 and a support bar 41. As shown in FIG. 4, the joint 40 has a fixing hole 40*a* that opens downward and a fixing hole 40*b* that opens sideward. The upper end of the upper pipe 32 is inserted into the lower fixing hole 40*a* and fixed to the joint 40 by a pin 40*c*. The support bar 41, which supports the mount 14 with the support pipe 13, is inserted into the upper fixing hole 40*b*. The support bar 41 is fixed to the joint 40 by two pins 40*d*.

The support bar 41 has a hexagonal cross-section and extends linearly. The support bar 41 is arranged so that its axis is horizontally and extends in the forward and rearward directions. The support bar 41 supports the mount 14 so that the mount 14 is movable along the axis of the support bar 41.

As shown in FIGS. 3 and 4, the mount 14 includes a cover 43, a clamp 44, two ball-end rods 45, and two pressing members 46. The cover 43 is formed by a generally triangular upper wall 43*a*, a lower wall 43*b*, and three side walls 43*c*. Each ball-end rod 45 is formed by a ball member 45*a* and a generally L-shaped rod 45*b*. A side drum SD is fixed to the rod 45*b* of each ball-end rod 45 by a fastening tool 1 (see FIG. 7). Each ball member 45*a* is arranged in an outer portion of the interior of the cover 43 and rotatably supported by the pressing member 46 from beneath the cover 43.

Each pressing member 46 has one end pivotally connected to the cover 43 by a pin and another end fastened to the cover 43 by a screw 48 and a T-shaped nut 49 mated therewith. The tightening of the T-shaped nut 49 restricts the rotation of the ball member 45*a*. This restricts the inclination angle of the rod 45*b* with respect to the support pipe 13 and thereby restricts the inclination angle of the side drum SD. Loosening of the T-shaped nut 49 enables rotation of the ball member 45*a*. This enables adjustment of the inclination angle of the rod 45*b* with respect to the support pipe 13. In the preferred embodiment, the ball-end rods 45, the screws 48, and the T-shaped nuts 49 form an angle adjustment mechanism DA for adjusting the angle of the side drum SD.

Figure 5:
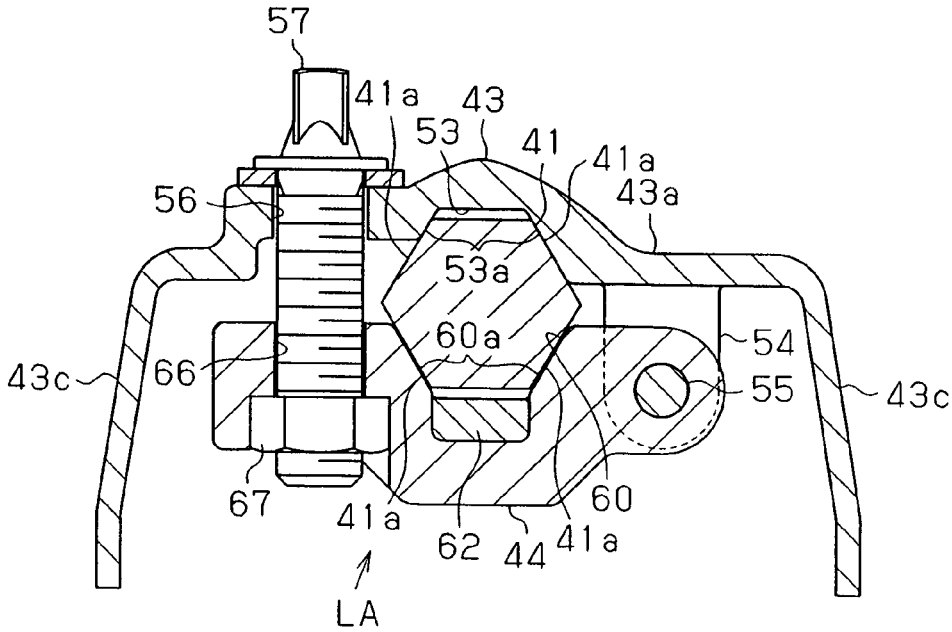
FIG. 5 is a cross-sectional view taken along line 5-5 in FIG. 2.
Figure 6:
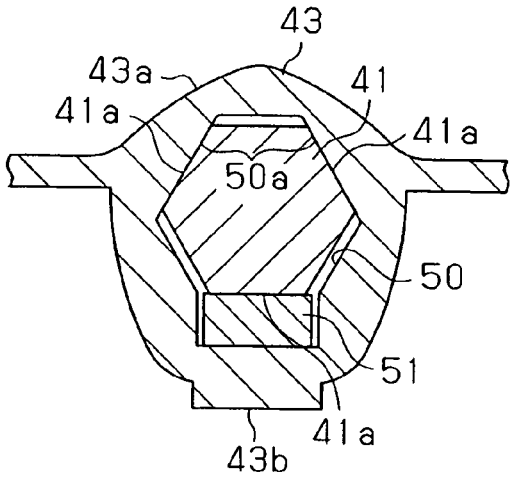
FIG. 6 is a partial cross-sectional view taken along line 6-6 in FIG. 2.

As shown in FIGS. 4 to 6, an insertion hole 50, which functions as a recess, extends through the cover 43 for insertion of the support bar 41, which supports the mount 14. The insertion hole 50 has a cross-section shaped to enable the support bar 41 to be fitted therein and extends linearly along the axis of the support bar 41. The insertion hole 50 opens in the side wall 43*c* of the cover 43 facing toward the joint 40. A guide plate 51, which is rectangular and formed of a resin, is arranged in the insertion hole 50. The upper portion of the support bar 41, which has a hexagonal cross-section, includes two wall surfaces 41*a* that respectively abut against the inner wall surfaces 50*a* defining the insertion hole 50. The lower portion of the support bar 41 includes a wall surface 41*a* abutting against the top surface of the guide plate 51.

In the cover 43, a first groove 53, which functions as a recess, having a trapezoidal cross-section is formed in the inner surface of the upper wall 43*a* so as to extend linearly from the above-mentioned insertion hole 50. The support bar 41 is arranged so that its upper portion is fitted in the first groove 53. In the upper portion of the support bar 41, two wall surfaces 41*a* respectively abut against wall surfaces 53*a* of the first groove 53.

Additionally, a projection 54 is integrally formed on the upper wall 43*a* for supporting the clamp 44. The projection 54 projects downward from the inner surface of the upper wall 43*a*. A pin 55 rotatably supports the basal end of the clamp 44 relative to the projection 54. A first through hole 56 extends through the upper wall 43*a* of the cover 43 in correspondence with the distal end of the clamp 44. An adjustment screw 57, which functions as a fastener, is inserted into the first through hole 56. A second through hole 66 is formed in the clamp 44 at a position corresponding to the first through hole 56 of the cover 43. The adjustment screw 57 is inserted through the second through hole 66 of the clamp 44 from the first through hole 56 of the cover 43. A nut 67 is mated with the distal end of the adjustment screw 57. The adjustment screw 57 is tightened to integrally assemble the cover 43 and the clamp 44.

A second groove 60, which functions as a recess, is formed in the upper surface of the clamp 44. The second groove 60 has a trapezoidal cross-section and extends linearly along the axis of the support bar 41. The support bar 41 is arranged so that its lower portion is fitted into the second groove 60. In the lower portion of the support bar 41, two wall surfaces 41*a* respectively abut against the inner wall surfaces 60*a* of the second groove 60.

A wall 62 extends orthogonally to the direction of extension of the second groove 60 from the generally middle portion of the second groove 60 in the clamp 44. A stopper pin 63 is fastened to the distal end of the support bar 41. Accordingly, rearward movement (toward the left as viewed in FIG. 4) of the mount 14 is enabled until the wall 62 of the clamp 44 abuts against the stopper pin 63 of the support bar 41. In the preferred embodiment, the wall 62 and the stopper pin 63 form a stopping means for preventing the mount 14 from falling off the support bar 41.

When the adjustment screw 57 is tightened, the support bar 41 is held firmly from above and below by the cover 43 and the clamp 44. This fixes the position of the mount 14 relative to the support bar 41. The loosening of the adjustment screw 57 enables the position of the mount 14 to be changed relative to the support bar 41. In the preferred embodiment, the cover 43, the clamp 44, and the adjustment screw 57 form a longitudinal position adjustment mechanism LA for adjusting the position of the side drum SD in a longitudinal direction, or rearward and forward directions.

The tom holder 10 enables the height of the side drums SD to be adjusted with the height adjustment mechanism HA, and the angles of the side drums SD to be individually adjusted with the corresponding angle adjustment mechanisms DA. After the adjustment of the height and the angles of the side drums SD, the position of the side drums SD in the forward and rearward directions is adjusted by moving the mount 14 horizontal relative to the support bar 41 with the longitudinal adjustment mechanism LA. When doing so, the positional relationship between the side drums SD is kept constant. By carrying out these procedures, the side drums SD may be arranged at positions enabling the drummer to beat the drums most comfortably.

Figure 7:
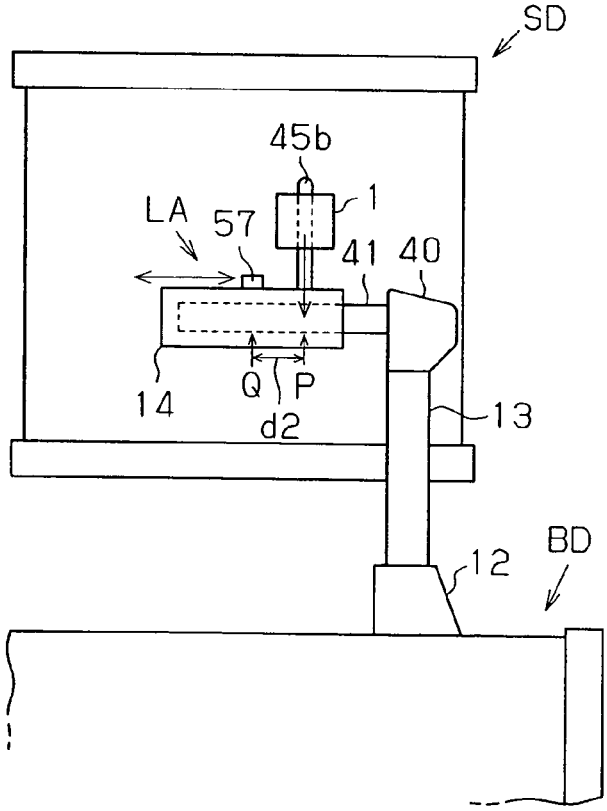
FIG. 7 is a schematic diagram showing a state in which a side drum is attached to the tom holder of the preferred embodiment.
Figure 12:
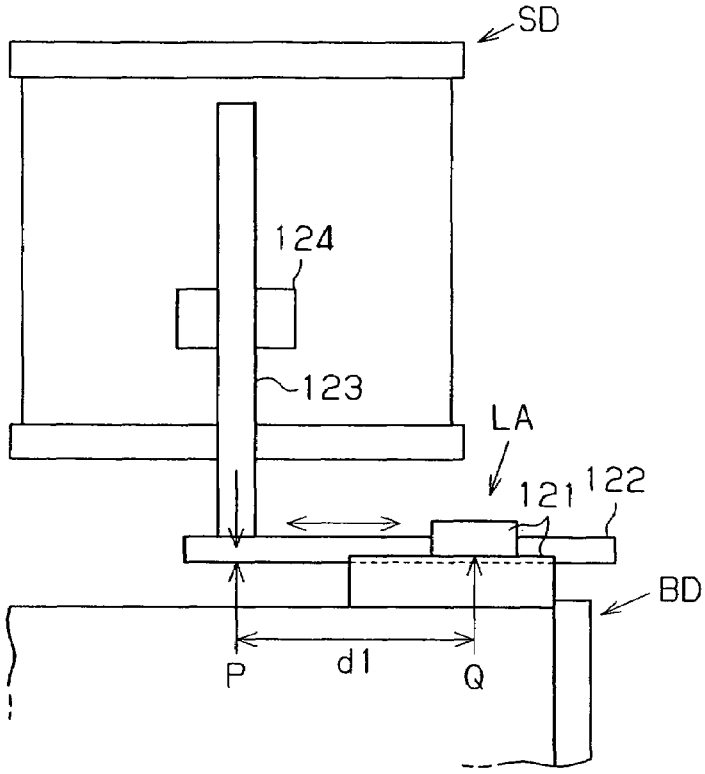
Fig.12(Prior Art)
FIG. 12 is a schematic view showing a state in which a side drum is held by a tom holder in the prior art.
Figure 13:
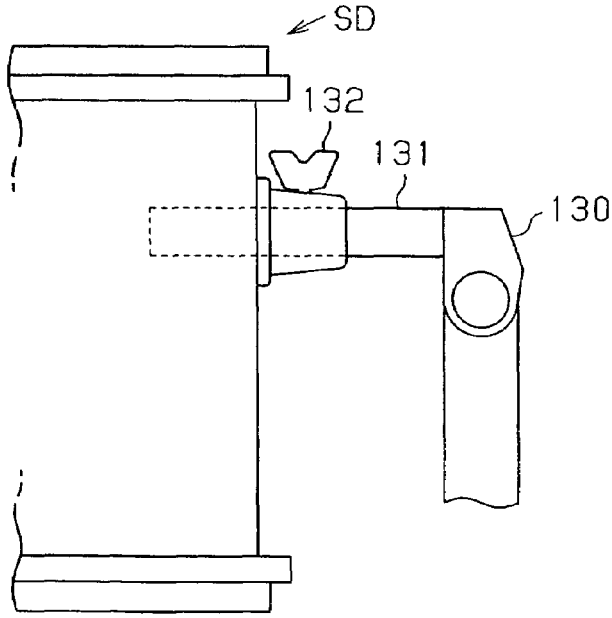
Fig.13(Prior Art)
FIG. 13 is a partial side view showing a mount of a tom holder in the prior art.
Figure 14:
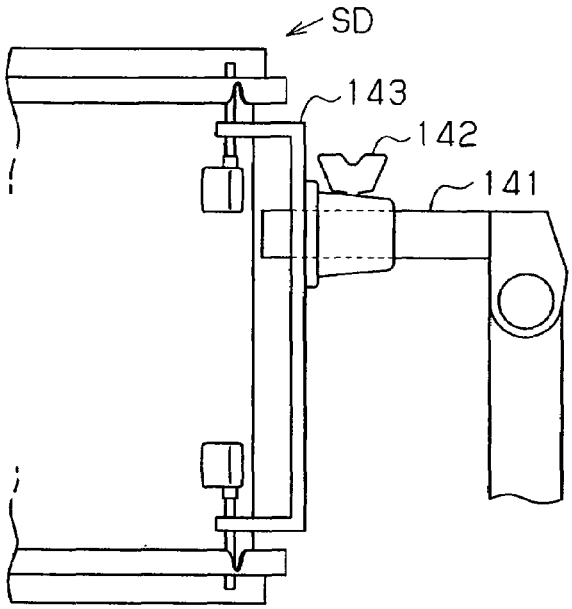
Fig.14(Prior Art)
FIG. 14 is a partial side view showing a mount of a tom holder in the prior art.
Figure 15:
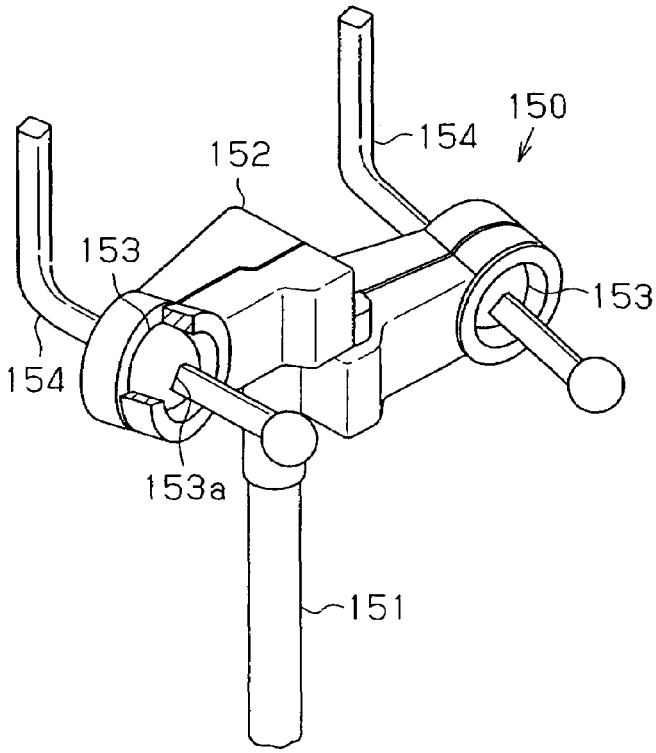
Fig.15(Prior Art)
FIG. 15 is a partial cutaway perspective view showing a mount of a tom holder in the prior art.

The operation of the tom holder 10 will now be described with reference to FIGS. 7 and 12 in comparison with the prior art. FIG. 7 is a schematic diagram showing the tom holder 10 of the preferred embodiment. FIG. 12 is a schematic diagram showing a tom holder of the prior art.

In the prior art tom holder shown in FIG. 12, the fore-and-aft adjustment mechanism LA for adjusting the position of the side drum SD in the forward and rearward directions includes a fastening piece 121 and a support bar 122 as described above. In this case, the distance d1 between the load point P where the load of the side drum SD is applied and the fixed point Q where the support bar 122 is fixed is long. This produces a bending force between the fastening piece 121 and the support bar 122.

Comparatively, the tom holder 10 of the preferred embodiment employs the longitudinal adjustment mechanism LA, which includes the support bar 41 extending forward from the support pipe 13 and the mount 14 movably supported relative to the support bar 41. Reference character d2 denotes the distance between the load point P where the load of the side drum SD is applied and the fixed point Q where the support bar 41 is fixed (the point tightened by the adjustment screw 57). In this case, the longitudinal direction adjustment mechanism LA is arranged in the mount 14. Thus, the distance d2 between the load point P and the fixed point Q is much shorter than the distance d1 shown in FIG. 12. This reduces the load applied to the fixed point Q of the support bar 41 and minimizes the bending force produced between the support bar 41 and the mount 14. Accordingly, the side drum SD is horizontally movable even when mounted on the mount 14.

The preferred embodiment has the advantages described below.

(1) The tom holder 10 includes the support bar 41, which extends in the forward and rearward directions, and the mount 14, which is supported on the support bar 41 movably in the axial direction. The tom holder 10 further includes the longitudinal adjustment mechanism LA, which adjusts the position of the side drum SD mounted on the mount 14 in the forward and rearward directions. Accordingly, position adjustment of the side drum SD in the horizontal direction is enabled by changing the position of the mount 14 relative to the support bar 41. Further, the distance d2 between the load point P where the load of the side drum SD is applied and the fixed point Q where the support bar 41 is fixed is significantly shortened in comparison with the prior art. This reduces the load applied to the fixed point Q of the support bar 41 and minimizes bending force produced between the support bar 41 and the mount 14. Accordingly, horizontal movement of the side drum SD is enabled even when the side drum SD is mounted on the mount 14.

(2) The insertion hole 50 formed in the cover 43, the first groove 53 in the inner surface of the upper wall 43*a* of the cover 43, and the second groove 60 in the upper surface of the clamp 44 all extend along the axis of the support bar 41. Further, the mount 14 is supported by the support bar 41, which is arranged in the insertion hole 50 and the first and second grooves 53 and 60. Accordingly, smooth movement of the mount 14 along the axial direction of the support bar 41 is enabled by moving the support bar 41 in the insertion hole 50 and the first and second grooves 53 and 60. This facilitates position adjustment of the side drums SD in the forward and rearward directions. Further, the support bar 41 is inserted through the insertion hole 50 of the cover 43. This prevents the support bar 41 and the mount 14 from rattling against each other even if the cover 43 and the clamp 44 are not fastened to each other.

(3) The support bar 41 has a hexagonal cross-section, and the first and second grooves 53 and 60 have trapezoidal cross-sections. The mount 14 is supported with the upper and lower portions of the support bar 41 fitted in the first and second grooves 53 and 60, respectively. This prevents the side drums SD mounted on the mount 14 from rotating about the axis of the support bar 41 regardless of external application of a strong impact or vibration. This ensures that the mount 14 is fixed to the support bar 41 and that the side drums SD are held at the same positions subsequent to position adjustment.

(4) The guide plate 51, which is made of a resin, is arranged in the insertion hole 50 of the cover 43. When the mount 14 is moved relative to the support bar 41, the mutual sliding of the support bar 41 on the guide plate 51 enables further smooth movement of the mount 14 relative to the support bar 41. Even if the support bar 41 is fitted tightly in the insertion hole 50, repetitive sliding between the mount 14 and the guide plate 51 would result in compressive deformation or wear of the guide plate 51. As a result, movement of the support bar 41 relative to the mount 14 would gradually become smooth.

(5) The adjustment screw 57 is inserted into the second through hole 66 of the clamp 44 from the first through hole 56 of the cover 43. The nut 67 is mated with the distal end of the adjustment screw 57. Accordingly, the support bar 41 is held tightly between the cover 43 and the clamp 44 by fastening the cover 43 and the clamp 44 with the adjustment screw 57. This fixes the mount 14 to the support bar 41 and ensures that the side drums SD are held at the adjusted positions.

(6) The tom holder 10 has the stopping means, which includes the wall 62 located at the generally middle portion of the second groove 60, and the stopper pin 63, which is fastened to one end of the support bar 41. This prevents the side drums SD, which are heavy, from falling off the support bar 41 together with the mount 14 when adjusting the positions of the side drums SD in the forward and rearward directions.

(7) The tom holder 10 includes the angle adjustment mechanism DA for adjusting the angle of each side drum SD. The angle adjustment mechanisms DA enable the angles of the side drums SD to be adjusted so that the side drums SD may be beat at positions most comfortable to the drummer.

(8) The tom holder 10 includes the height adjustment mechanism HA for adjusting the height of the side drums SD. The height adjustment mechanism HA enables the position of the upper pipe 32 with respect to the lower pipe 31 to be changed in order to adjust the overall length of the support pipe 13. This enables the height of the side drums SD to be adjusted so that the side drums SD may be beat at positions most comfortable to the drummer.

(9) The tom holder 10 includes the fastening piece 12, which is fixed to the bass drum BD. The fastening piece 12 includes the support pipe 13, which is removable. Accordingly, the support pipe 13 may be removed from the fastening piece 12 and be mounted on another bass drum BD. Therefore, the tom holder 10 has high versatility.

It should be apparent to those skilled in the art that the present invention may be embodied in many other specific forms without departing from the spirit or scope of the invention. Particularly, it should be understood that the present invention may be embodied in the following forms.

Figure 8:
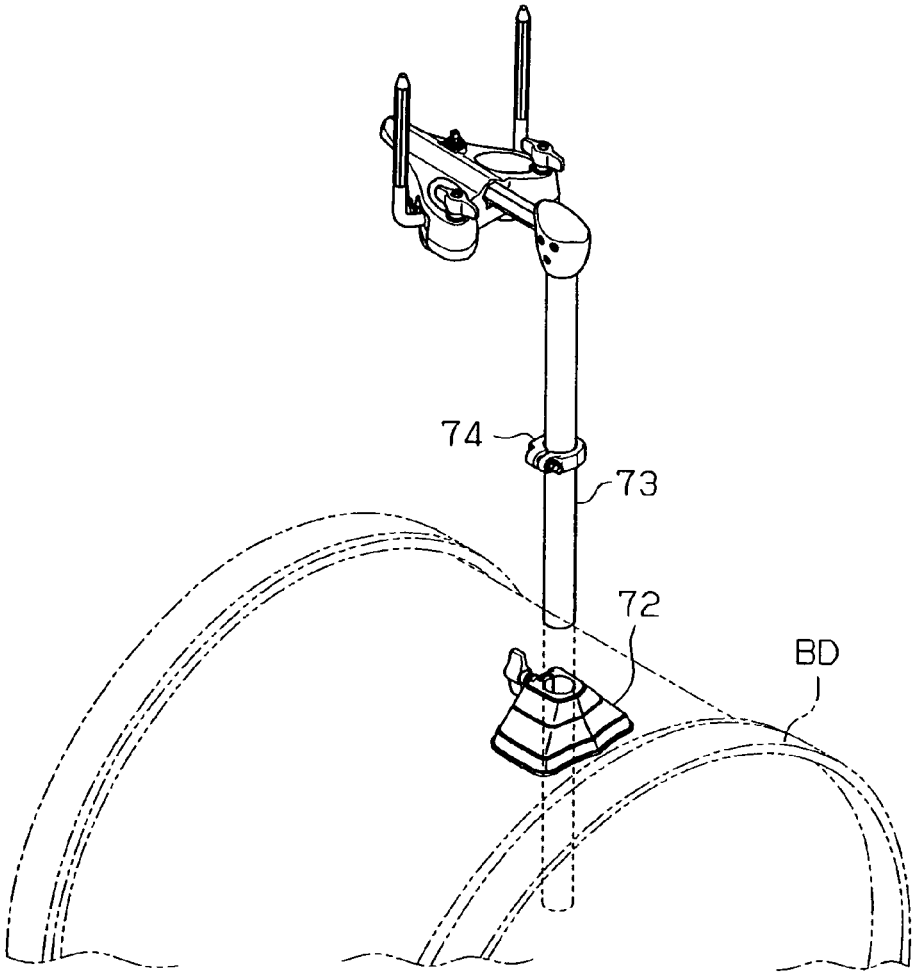
FIG. 8 is a perspective view showing a modification of the mounting structure for the tom holder.

In the conventional tom holder shown in FIG. 12, the fastening piece 121 for movably supporting the support bar 122 is fixed to the body of the bass drum BD. Referring to FIG. 8, this disables the use of the height adjustment mechanism HA when the height adjustment mechanism HA adjusts the height of the side drum SD by inserting a support pipe 73 into an insertion hole formed in the body of the bass drum BD and changing the amount the support pipe 73 is inserted in the bass drum BD. In contrast, the tom holder 10 of the preferred embodiment employs the longitudinal adjustment mechanism LA in the mount 14. This, the structure of FIG. 8 may be employed. This would enlarge the adjustable height range of the side drum SD. In the tom holder shown in FIG. 8, a memory lock 74 is attached to the support pipe 73 to determine the position of the support pipe 73 with respect to the fastening piece 12, that is, the height of the side drums SD.

The height adjustment mechanism HA used in the preferred embodiment for adjusting the height of the side drums SD may be omitted.

Figure 9:
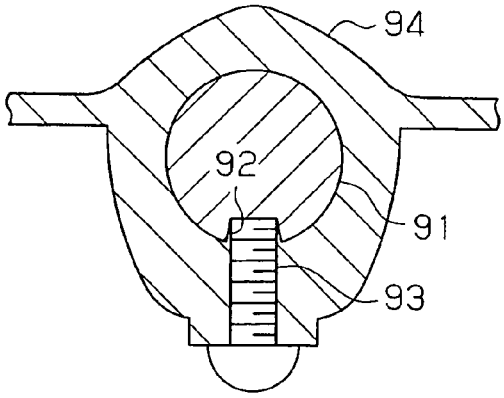
FIG. 9 is a partial cross-sectional view showing a modification of the support structure for a mount.

Although the preferred embodiment supports the mount 14 be inserting the support bar 41 through the insertion hole 50 and the space defined between the first and second grooves 53 and 60, the mount 14 may be supported in other ways. For example, as shown in FIG. 9, a groove 92 may be formed in the support bar 91 extending in the axial direction, and a projection 93 formed in a mount 94 may be engaged with the groove 92. In this case, the mount 94 is moved along the axis of the support bar 91 by moving the projection 93 along the groove 92.

Figure 10A:
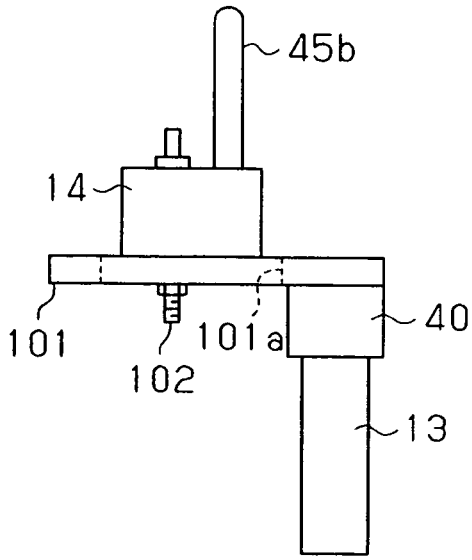
FIG. 10(A) is a partial side view schematically showing a modification of the support structure for the mount.
Figure 10B:
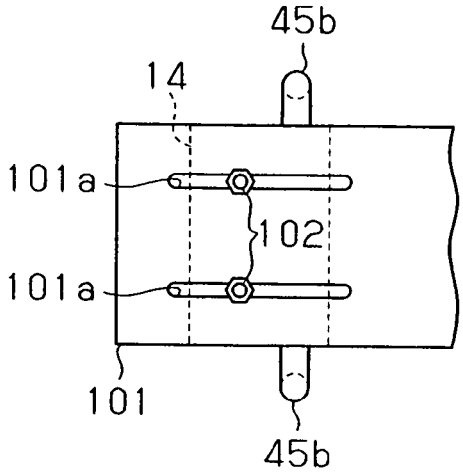
FIG. 10(B) is a partial bottom view schematically showing the support structure of FIG. 10(A)

Although the preferred embodiment employs the support bar 41 for supporting the mount 14, a support member having any shape may be employed. For example, as shown in FIGS. 10(A) and 10(B), a planar support plate 101 may be arranged on the upper end of the support pipe 13 to movably support the mount 14. In this case, the support plate 101 includes two slots 101*a* extending in the forward and rearward directions (in the leftward and rightward directions as viewed in FIG. 10(B)). The position of the mount 14 is fixed in the forward and rearward directions by tightening fastening screws 102. The position of the mount 14 becomes adjustable in the forward and rearward directions by loosening the fastening screws 102.

Figure 11:
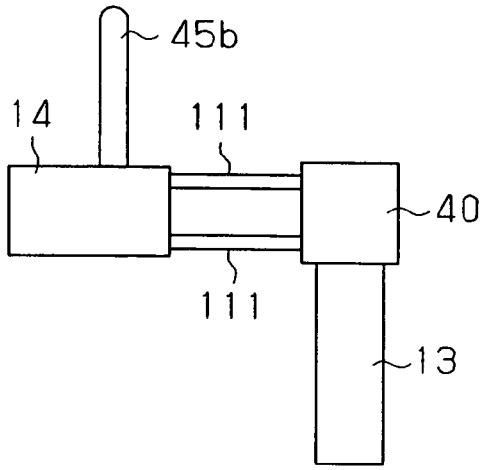
FIG. 11 is a partial side view schematically showing a modification of the support structure for a mount.

In the preferred embodiment, the mount 14 is supported by the single support bar 41. However, the mount 14 may be supported by a plurality of support bars. For example, as shown in FIG. 11, two support bars 111 may be arranged horizontally to support the mount 14 in a manner movable relative to the support bars 111. In this case, the cross-sectional shape of the support bars 111 does not have to be polygonal and may be circular.

In the preferred embodiment, the support bar 41 and the insertion hole 50 both have a hexagonal cross-section. However, the cross-sections of the support bar 41 and insertion hole 50 may have other polygonal shapes, such as triangular or quadrangular shapes. In this case, the cross-sectional shapes of the first groove 53 and second groove 60 may also be changed in accordance with the cross-sectional shape of the support bar 41.

In the preferred embodiment, the guide plate 51 is formed of a resin. However, the guide plate 51 may be formed from any other material as long as it has high lubricity, such as a ceramic or a metal.

In the preferred embodiment, the number of side drums SD that can be supported by the tom holder 10 may be changed as required. In such a case, the number of ball-end rods 45 in the tom holder 10 is determined in accordance with the number of side drums SD that are supported.

In the preferred embodiment, the angle adjustment mechanism DA for adjusting the angle of the side drum SD may be omitted.

In the preferred embodiment, the tom holder 10 supports the side drums SD on the bass drum BD. However, the present invention may be embodied, for example, in a support device that supports the side drums SD on a stand having a foldable tripod plate.

The present examples and embodiments are to be considered as illustrative and not restrictive, and the invention is not to be limited to the details given herein, but may be modified within the scope and equivalence of the appended claims.

What is claimed is:

1. A support device for side drums, the support device comprising:

a mount to which a pair of side drums may be attached and supported thereby;

a support post for supporting the mount;

a position adjustment mechanism for adjusting the position of each side drum in a horizontal direction;

a support bar arranged on the support post and extending horizontally;

the mount being supported to be movable relative to the support bar along the axis of the support bar; and the position adjustment mechanism is operable to change the position of the mount relative to the support bar and to adjust the position of each side drum in the horizontal direction.

2. The support device according to claim 1, wherein the mount includes a recess extending along the axis of the support bar, and the support bar is received in the recess to support the mount.

3. The support device according to claim 2, wherein the support bar is engaged with the recess to restrict rotation of the mount about the axis of the support bar.

4. The support device according to claim 3, wherein the support bar has a polygonal cross-section, the recess has a polygonal cross-section, and the mount is supported in a state in which an outer surface of the support bar contacts a wall surface of the recess.

5. The support device according to claim 4, further comprising: a guide plate arranged in the recess between the support bar and the mount.

6. The support device according to claim 5, wherein the guide plate is formed of a resin and supports the mount on the support bar.

7. The support device according to claim 1, further comprising: an angle adjustment mechanism for adjusting inclination angle of the side drum relative to the support post.

8. The support device according to claim 1, wherein the support post includes a lower pipe and an upper pipe connected to the mount by the support bar and inserted into the lower pipe, the support device further comprising: a height adjustment mechanism for adjusting the position of the upper pipe relative to the lower pipe.

9. The support device according to claim 1, further comprising: a fastening piece fixed to a bass drum, the support post being removably attached to the fastening piece.

10. The support device according to claim 9, wherein the position of the support post relative to the fastening piece is adjustable, the support device further comprising: a positioning member for determining the position of the support pipe relative to the fastening piece.

11. The support device according to claim 1, wherein the mount supports a pair of side drums in a fixed positional relationship between the pair of side drums with the mount being moved along the axis of the support bar.

12. A support device for a side drum, the support device comprising:

a mount to which the side drum is attached;

a support post for supporting the mount;

a position adjustment mechanism for adjusting the position of the side drum in a horizontal direction;

a support bar arranged on the support post and extending horizontally;

the mount being supported to be movable relative to the support bar along the axis of the support bar;

wherein the mount includes: a cover for covering the support bar from above; a clamp for supporting the support bar from below; and a fastener for fastening the cover to the clamp to fix the mount to the support bar; and the position adjustment mechanism is operable to change the position of the mount relative to the support bar and to adjust the position of the side drum in the horizontal direction.

13. The support device according to claim 12, wherein the recess includes an insertion hole through which the support bar is inserted, a first groove extending linearly from the insertion hole, and a second groove arranged in the clamp, the insertion hole and the first groove being arranged in the cover.

14. The support device according to claim 13, wherein the support bar has a hexagonal cross-section, and each of the through hole, the first groove, and the second groove has a cross-sectional shape enabling the support bar to be received.

15. The support device according to claim 13, wherein: the insertion hole has a bottom portion on which the guide plate is arranged; and the support bar has an upper portion, with two outer surfaces for contacting a wall surface of the insertion hole, and a lower portion, with an outer surface for contacting an upper surface of the guide plate.

16. The support device according to claim 13, wherein the support bar has an upper portion, with two outer surfaces for contacting a wall surface of the first groove, and a lower portion, with two outer surfaces for contacting a wall surface of the second groove.

17. The support device according to claim 16, further comprising: a stopper for preventing the mount from falling off the support bar.

18. The support device according to claim 17, wherein the stopper includes: a wall arranged in the second groove; and a block arranged at a distal end of the support bar, the wall contacting the block when the mount is moved to a predetermined position with respect to the support bar.

* * * * *

UNITED STATES PATENT AND TRADEMARK OFFICE

CERTIFICATE OF CORRECTION

PATENT NO. : 7,381,876 B2
APPLICATION NO. : 11/326219
DATED : June 3, 2008
INVENTOR(S) : Hideyuki Miyajima It is certified that error appears in the above-identified patent and that said Letters Patent is hereby corrected as shown below:

Title page,
Item (73) Assignee should read:
Hoshino Gakki Mfg. Co., Ltd. (JP)

Signed and Sealed this

Twenty-fifth Day of November, 2008

JON W. DUDAS
*Director of the United States Patent and Trademark Office*